United States Patent [19]

Horning

[11] Patent Number: 4,653,578

[45] Date of Patent: Mar. 31, 1987

[54] HEAT EXCHANGER

[75] Inventor: Bent Horning, Copenhagen, Denmark

[73] Assignee: F. L. Smidth & Co. A/S, Copenhagen, Denmark

[21] Appl. No.: 681,858

[22] Filed: Dec. 14, 1984

[30] Foreign Application Priority Data

Dec. 30, 1983 [GB] United Kingdom ..... 8334649

[51] Int. Cl.[4] ..... F28D 11/06

[52] U.S. Cl. ..... 165/84; 165/95; 122/379

[58] Field of Search ..... 165/84, 95; 122/379

[56] References Cited

U.S. PATENT DOCUMENTS

| | | | |
|---|---|---|---|
| 2,664,274 | 12/1953 | Worn et al. | 165/84 X |
| 3,389,974 | 6/1968 | Barattini et al. | 165/84 X |
| 3,997,000 | 12/1976 | Piela | 122/379 |
| 4,018,267 | 4/1977 | Tomasicchio | 122/379 X |
| 4,497,282 | 2/1985 | Neundorfer | 122/379 |

FOREIGN PATENT DOCUMENTS

| | | | |
|---|---|---|---|
| 1128495 | 7/1982 | Canada | 165/84 |

*Primary Examiner*—Albert W. Davis, Jr.
*Assistant Examiner*—Peggy Neils
*Attorney, Agent, or Firm*—Brumbaugh, Graves, Donohue & Raymond

[57] ABSTRACT

A heat exchanger for transferring heat from a dust-containing gaseous medium to a second medium comprises a housing (3) with an inlet (1) and an outlet (5) for the gaseous medium, which flows along a U-shaped path around a partition wall (2) suspended from a top plate (4). The second medium flows along U-shaped pipes (6) in the U-shaped path from an inlet chamber (29) to an outlet chamber (28). Rapping cylinders (13), which are mounted on the top plate (4), periodically rap the pipes (6) to dislodge dust from the pipes into a discharge hopper (12). The top plate is mounted via resilient supports (31) on the upper edge of the housing (3).

3 Claims, 5 Drawing Figures

HEAT EXCHANGER

BACKGROUND OF THE INVENTION

The invention relates to a heat exchanger for transferring heat from a dust-containing gaseous medium, e.g. air or other gas, to a second fluent medium, such as air, the two media being kept separate from one another. A known kind of such heat exchanger (hereinafter referred to as of the kind described) consists of a housing, with a preferably rectangular cross-section. At the upper part of the housing are provided a gas inlet and a gas outlet, between which is provided for the gaseous medium a U-shaped path through the housing, the path being partly defined by a partition wall suspended from a top plate of the housing. A number of U-shaped pipes, the individual ends of which are secured to the top plate, at the upper side of which they open upon opposite sides of the suspended partition, are mounted in the U-shaped path and form a path for the second medium which is fed through the pipes. Two chambers with an inlet and an outlet, respectively, are provided above the pipe ends, one on each side of the partition. The partition walls, the chambers and the top plate constitute a top section of the heat exchanger. Such heat exchangers with suspended U-shaped pipes in a U-shaped path are in principle known for instance from No. DE-A-28 46 581.

When a heat exchanger of the kind described is used for cooling dust-containing gases or recovering heat therefrom, the gases are passed along the U-shaped path through the housing, while the cooling medium or the carrying medium for the recovered heat is passed through the U-shaped pipes countercurrently to the gas flow through the housing along its U-shaped path. On its way through the housing some of the dust is precipitated, and the housing is provided at its bottom with a discharge hopper for precipitated dust.

Part of the dust, however, settles on the pipes and impairs the heat transfer from one medium to the other, and it is necessary from time to time to clean the pipes of precipitated dust. Normally this is done by stopping the plant for some time while purely mechanical cleaning of the pipes is effected, e.g. by blowing them clean by pressurized air, possibly with the addition of some kind of abrasive grain.

It is the object of the invention to devise a heat exchanger of the kind described by which the pipes can be kept constantly clean during uninterrupted operation of the heat exchanger.

SUMMARY OF THE INVENTION

According to the invention the object is achieved by providing the heat exchanger with one or more rapping mechanisms, which, at intervals, during the operation of the heat exchanger, act upon the pipes substantially in their longitudinal direction, so as to make them vibrate.

The rapping mechanisms are preferably mounted in brackets on the top plate of the housing, and are constructed in such a way that the raps are directed perpendicularly to the top plate in the longitudinal direction of vertical branches of the U-shaped pipes.

To prevent the impact force from propagating through the housing to its foundation, the top plate, which carries the partition walls, pipes and the rapping mechanism, may rest resiliently on the top, e.g. an upper edge, of the housing.

Further rapping mechanisms may be provided at the lower part of the housing so as to act upon the horizontal parts of the U-shaped pipes in their longitudinal direction.

The rapping mechanisms may advantageously consist of pneumatic cylinders which are activated at intervals, and from which an impact pulse may be transmitted via a rod or rods to the top plate of the housing, to which plate the pipes are secured.

However, the invention should not be restricted to the use of pneumatic cylinders and other kinds of rapping mechanisms may be used, such as rapping hammers which are lifted by a rotating shaft and perform the rapping when they substantially fall under gravity.

In that the rapping mechanisms act upon the pipes in their longitudinal direction it is ensured that longitudinal and transverse vibrations develop in the pipes to loosen dust thereon. The longitudinal vibrations are superimposed on transverse vibrations which will hurl the loosened material away from the pipes.

BRIEF DESCRIPTION OF THE FIGURES

The invention is now explained in more detail, by way of example with reference to the accompanying drawings, in which.

DETAILED DESCRIPTION OF THE PREFERRED EMBODIMENT

Figures 1, 2:
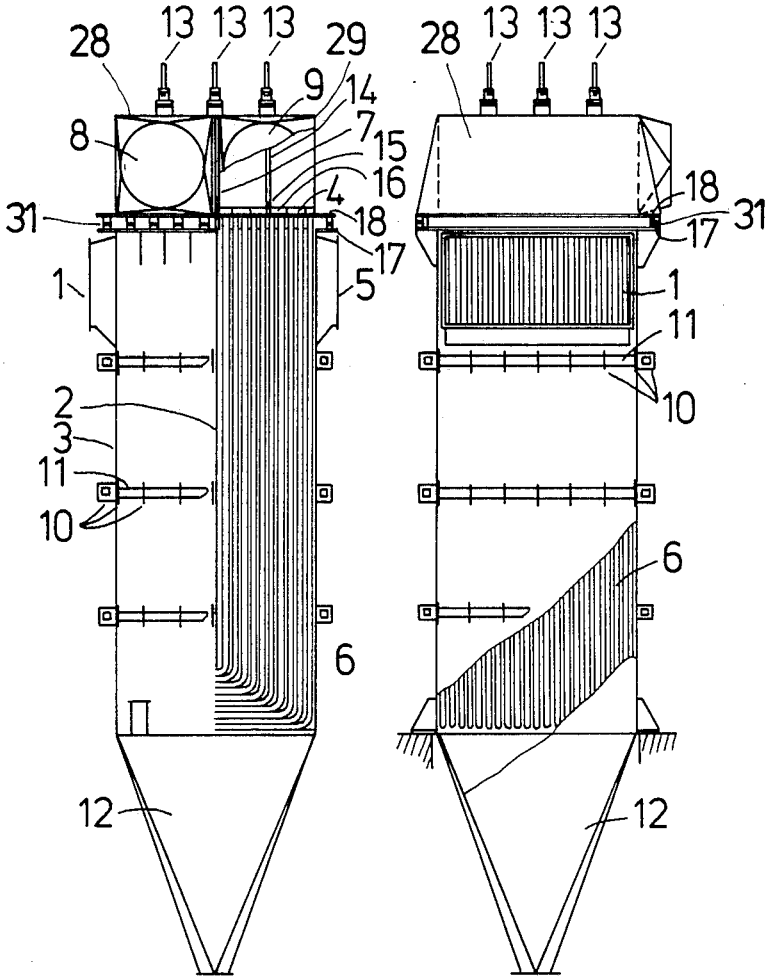
FIG. 1 is a front view of a heat exchanger according to the invention, partly in section.
FIG. 2 is a side view of the heat exchanger, partly in section.
Figure 3:
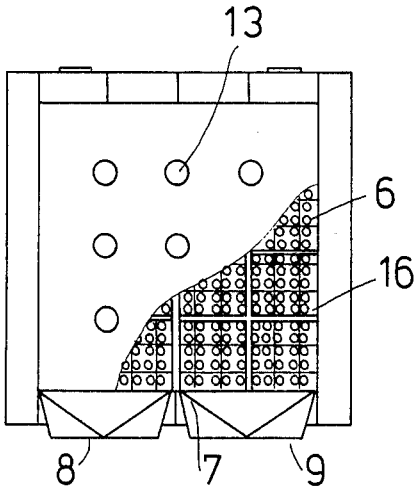
FIG. 3 is a top view of the heat exchanger, partly in section.

The heat exchanger (FIGS. 1, 2 and 3) is provided with a gas inlet 1 from which a U-shaped channel leads to a gas outlet 5; the channel is formed by a partition wall 2 suspended from a top plate 4 into a box shaped housing 3, the walls of which are, in the illustrated construction, stiffened by mounting eyes 10 interspaced across the wall and locking bolts 11, which may each at one end be welded to an eye, inserted through the eyes.

A number of U-shaped pipes 6 follow the U-shaped channel through the heat exchanger housing 3, they are secured to the top plate 4 with their open ends at the upper side of the plate. In continuation of the suspended partition wall a wall 7 divides the space above the top plate 4 into two chambers 28 and 29 which are interconnected by the U-pipes 6 and each of which is provided with an opening constituting an outlet 8 and an inlet 9, respectively.

The cooling medium, preferably air, is led through the air inlet 9 into one of the chambers 29 above the top plate 4. From this chamber the cooling medium flows through the U-shaped pipes to the other chamber 28 from which it is led out through the air outlet 8.

Exit gas from a kiln or the like is passed along the U-shaped channel from the gas inlet 1 to the gas outlet 5, preferably in countercurrent to the cooling medium flowing in the U-shaped tubes 6. During this passage the gas is cooled, and part of the dust, which may be contained in the gas, is precipitated and falls down directly inside the heat exchanger housing 3 for discharge through a discharge hopper 12 at the bottom of the housing 3. Another part of the dust, however, settles on the U-shaped pipes where it impairs the heat transfer from the gas in the U-shaped channel to the cooling medium in the U-shaped pipes 6. Therefore measures are taken continuously to remove the dust which has settled on the U-shaped pipes.

For this purpose a number of pneumatic cylinders 13 are mounted in brackets (not shown) above the top plate 4 in brackets or the like (not shown) such that rods 14 extend downwardly from the cylinders to communicate, directly or indirectly, with top plate 4. The cylinders 13 are activated at intervals to subject the top plate 4, and hence the U-shaped pipes 6 secured to this plate, to a rapping impact.

The rapping impact, working perpendicularly to the top plate 4 and in the longitudinal direction of the vertical parts of the U-shaped pipes, is transferred from the cylinders 13 to the top plate 4 through a rod 14, an anvil 15 and a distributing lattice 16. When the U-shaped pipes are vibrated due to the rapping, deposited material is shaken off and falls down into the discharge hopper 12.

Further rapping cylinders may be mounted at the bottom of the heat exchanger housing to act on the horizontal parts of the U-shaped pipes in the longitudinal direction of these parts.

To prevent the impacts on, and the vibrations in, the top plate from being transferred to the heat exchanger housing 3, the top plate must be mounted on the housing in a resilient way. As the top plate with its suspended partition wall in combination with the housing form the U-shaped channel for the gas to be cooled, the joint between the top plate and the housing further has to be airtight.

Figure 4:
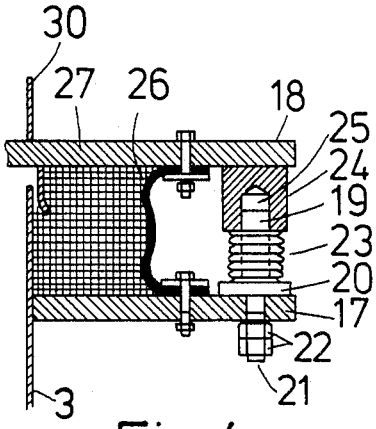
FIG. 4 is a section through a detail of the joint between the housing and top plate of the heat exchanger.
Figure 5:
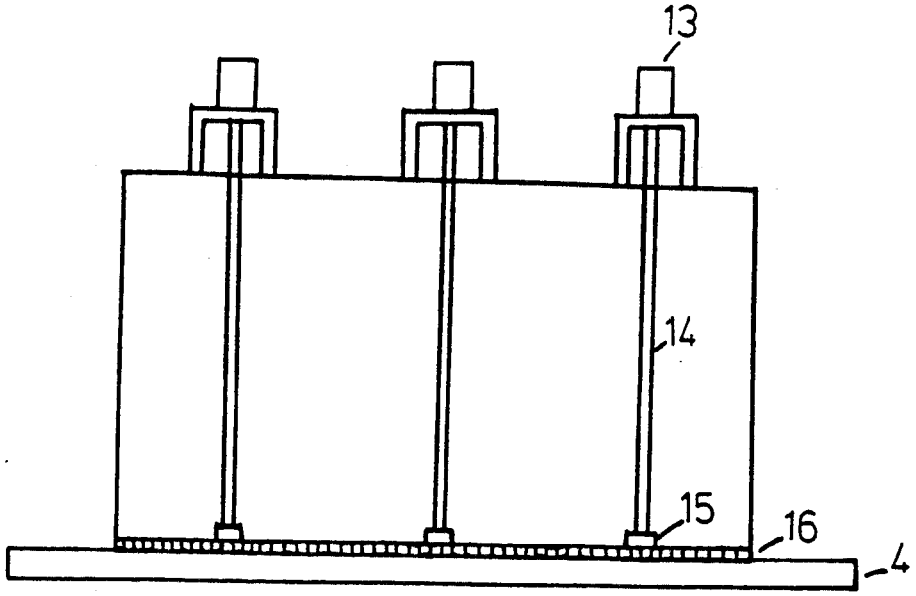
FIG. 5 is a schematic depicting the arrangement of the pneumatic cylinders on the top of the heat exchanger.

A detail of this resilient and airtight joint between the housing and the top plate is shown in FIG. 4. A flange 17 is mounted at the upper edge of the housing 3. A corresponding flange 18 is provided on the top plate 4, and may be a part of this plate, which part lies outside the wall 30 of the air chambers 28, 29 mounted on the upper side of the top plate. Between the flanges 17 and 18 is provided a sealing bellows 26 which is protected against heat from the gas passing through the heat exchanger by insulating material 27 provided inside the bellows.

Upon assembly of the heat exchanger, the sub assembly of the top plate 4 with its suspended wall 2, the U-shaped pipes 6, the air chambers 28 and 29 and the rapping cylinders 13 is retained by its weight in position in the housing, and the resilient joint between top plate and housing is achieved through the flange 18 of the top plate 4 resting on a number of resilient supports 31 bolted on the flange 17 of the housing.

The resilient supports 31 each (FIG. 4) consists of a spring guide 19 with a breast plate 20 and a threaded stud 21 projecting below the latter, the threaded stud passing through the flange 17 of the housing to which the spring guide 19 is secured by means of a nut 22.

On the breast plate 20 of the spring guide 19 are mounted a number of disc springs 23, on top of which rests a bearing boss 24 having a boring 25 enabling it to be lowered on to the spring guide 19 to bear against the spring discs 23 without the spring guide 19 reaching the bottom of the boring 25 of the bearing boss 24.

The construction shown also makes possible easy dismantling of the heat exchanger with a view to repair or cleaning, as the top plate and the pipes mounted thereof may simply be lifted out of the top of the heat exchanger housing.

What is claimed is:

1. In a heat exchanger for transferring heat from a first dust-containing gaseous medium, to a second fluent medium while said first and second media are kept separate from one another, said heat exchanger comprising a housing having a gas inlet and a gas outlet;

a U-shaped path for said first medium through said housing, said path being partly defined by a partition wall suspended from a top plate of said housing;

a number of U-shaped pipes for passage of said second medium and mounted in said U-shaped path, opposed ends of said pipes being secured to said top plate and opening at the upper side of said plate on opposite sides of said suspended partition wall;

first and second chambers, with an inlet and an outlet, respectively, above said pipe ends one on each side of a further partition wall;

whereby said partition walls, said air chambers and said top plate constitute a top section of said heat exchanger;

the improvement wherein said heat exchanger also has at least one rapping means adapted, at intervals, during the operation of said heat exchanger, to act upon said pipe so as to cause vibration of said pipe substantially in the longitudinal direction thereof, said rapping means being positioned and oriented such that raps generated thereby are directed perpendicularly to said top plate in the longitudinal direction of vertical branches of said U-shaped pipes.

2. A heat exchanger according to claim 1, wherein said top section rests via said top plate resiliently on the top of said housing.

3. A heat exchanger according to claim 1, wherein said rapping means consist of pneumatic cylinders and means for actuation thereof at intervals.

* * * * *